United States Patent [19]

Cornish

[11] 4,354,792

[45] Oct. 19, 1982

[54] TRAIN POSITIONER

[75] Inventor: James E. Cornish, North Olmsted, Ohio

[73] Assignee: Dravo Corporation, Pittsburgh, Pa.

[21] Appl. No.: 135,640

[22] Filed: Mar. 31, 1980

[51] Int. Cl.[3] ..... B65G 67/00; B61B 9/00

[52] U.S. Cl. ..... 414/359; 104/176; 104/162

[58] Field of Search ..... 414/359; 104/176, 173 R, 104/162; 198/737; 74/110; 254/337

[56] References Cited

U.S. PATENT DOCUMENTS

| | | | |
|---|---|---|---|
| 3,377,961 | 4/1968 | Hunt | 104/162 |
| 3,522,772 | 8/1970 | Hunt | 104/162 |
| 3,538,854 | 11/1970 | Oranczak | 104/162 |
| 3,695,185 | 10/1972 | Rose | 104/162 |
| 4,006,691 | 2/1977 | Kacir et al. | 104/176 |

*Primary Examiner*—Edward R. Kazenske
*Assistant Examiner*—L. E. Williams

[57] ABSTRACT

There is disclosed a train positioner for sequentially advancing a string of railroad cars to a rotary car dumper in a step-by-step and a car-by-car sequence. Each of the cars has rotatable couplings permitting the rotation of each car about a longitudinal axis. The rotary car dumper is adapted to invert a railroad car about that axis. Two car-pushing members are provided which are adapted to sequentially engage a car and advance the car toward the dumper. A drive arrangement is provided which is adapted to drive at least one of the pushing members forwardly toward the dumper a distance corresponding to about the length of a car while that pushing member is engaged with a car while retracting at least one other member rearwardly away from the dumper a distance corresponding to about the length of the car while being disengaged from a car.

10 Claims, 3 Drawing Figures

TRAIN POSITIONER

BACKGROUND OF THE INVENTION

This invention relates to train handling apparatus and, more specifically, to apparatus for indexing a train through a work station one or more cars at a time while the cars remain coupled.

Unit trains, usually comprising 100 or more cars of identical size, are recognized as efficient carriers of bulk raw materials, such as coal, iron ore, limestone, and liquid or dry chemicals. Of major concern in systems employing unit trains are the speed and reliability of equipment for handling such trains at work areas where they are loaded or unloaded. U.S. Pat. No. Reissue 27,300, for example, discloses railroad car handling apparatus which is adapted to automatically index a unit train through a rotary car dumper or other equipment for filling or emptying a car or a limited number of cars at a time. Various techniques for holding a train and indexing the train are used in addition to wheel chocks disclosed in the aforementioned patent. Wheel chocks, while providing adequate service in most installations, are inherently limited in their capacity for holding a train when the car with which they are engaged is empty, since the car, when driven by a heavy load, has a tendency to roll up over the chocks. Moreover, extremely high coupler loading on a chocked car may cause structural damage to the suspension area of the car's undercarriage.

Apparatus for stooping or otherwise locating a railroad car are shown in U.S. Pat. Nos. 2,017,392 to Blake and 3,220,576 to Cheek, showing stop arms pivotal in a vertical plane. U.S. Pat. Nos. 2,945,606 to Musschoot et al, and 3,799,064 to Kikuchi et al, are representative of devices for engaging a coupler which are retractable and/or operated from under the trackway. Such devices are typically limited to use with uncoupled car ends.

An improved train positioner is set forth in U.S. Pat. No. 4,006,691. According to the teachings of that patent, a train position control arm is provided which is adapted to engage a car by its coupler and which has certain features which are advantageous both in stationary train holding apparatus and with a traveling carriage of a train positioner. A car is advanced by the traveling train positioner arm, and when the car is advanced to its proper position, a train holding arm is lowered to engage a coupling. After the stationary arm is lowered, the traveling arm is raised and is retracted to a new position and then the stationary arm is raised. Some of the vertical movements of the stationary and movable arms are obviously outside of the indexing cycle and the dump cycle and tend to add time onto the entire dumping operation.

SUMMARY OF THE INVENTION

This invention provides a railroad car indexing apparatus which is adapted to sequentially advance railroad cars to a dumping station in a step-by-step manner. The apparatus is particularly adapted to advance trains of the "unit train" type which are intended to remain coupled during unloading, with one or more cars being rotated about an axis colinear with the axis of the car coupling members of the car. The apparatus includes track-mounted shuttle cars on both sides of the string of coupled cars, with arms mounted on said shuttle cars which are adapted to alternately engage a car to push the car forwardly. The arms are pivotally mounted on the shuttle cars so that one arm may be in a horizontal position to push the cars, while the other arm is in a vertical position to clear the cars. There is provided a drive for the cars which advances one shuttle car about the length of a railroad car while its arm is engaged with the car coupling while simultaneously retracting the other one of the shuttle cars rearwardly away from the car dumper a distance corresponding to the length of the car, while the arm on the shuttle car is raised. The drive arrangement comprises first and second pulleys on the forward, rearward ends, respectively, of each shuttle car. A first cable extends from a fixed member, passes around the second pulley on a shuttle car, around a driving winch, around the second pulley on another one of the shuttle cars, and then to a fixed member. A second cable extends from a fixed member, around the first pulley on one of the shuttle cars, around an idler pulley, around the first pulley on the other one of the shuttle cars, and then to a fixed member.

The foregoing arrangement eliminates a stationary car holding arm, such as the train holder apparatus 17 shown in U.S. Pat. No. 4,006,691. Furthermore, the present invention reduces the total cycle time of an indexing and dumping operation, since a shuttle car is being moved into its proper position for advancing the car while the other shuttle car is performing its advancement function.

DETAILED DESCRIPTION OF THE INVENTION

Figure 1:
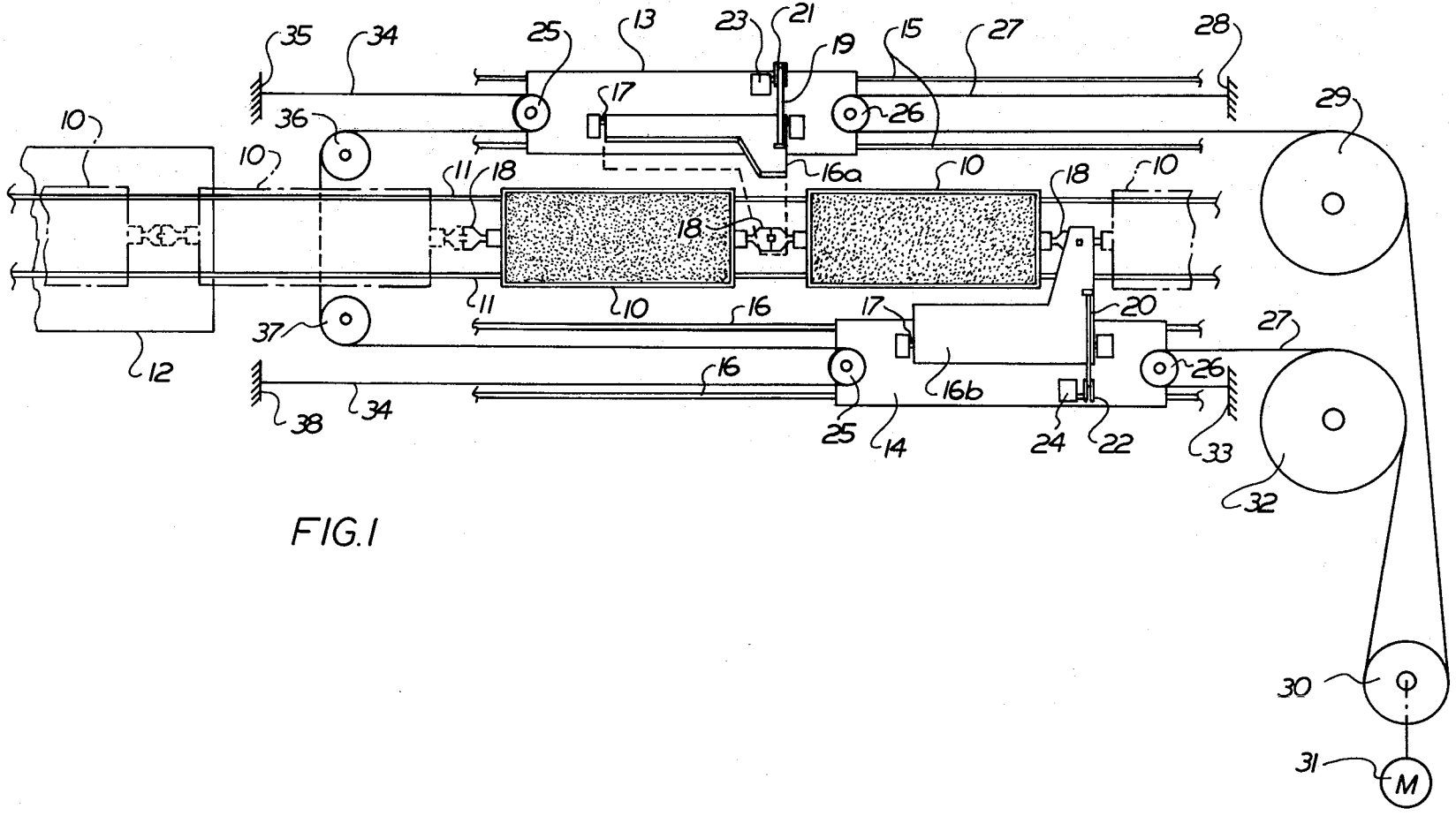
FIG. 1 is a plan view of the apparatus according to this invention.
Figure 2:
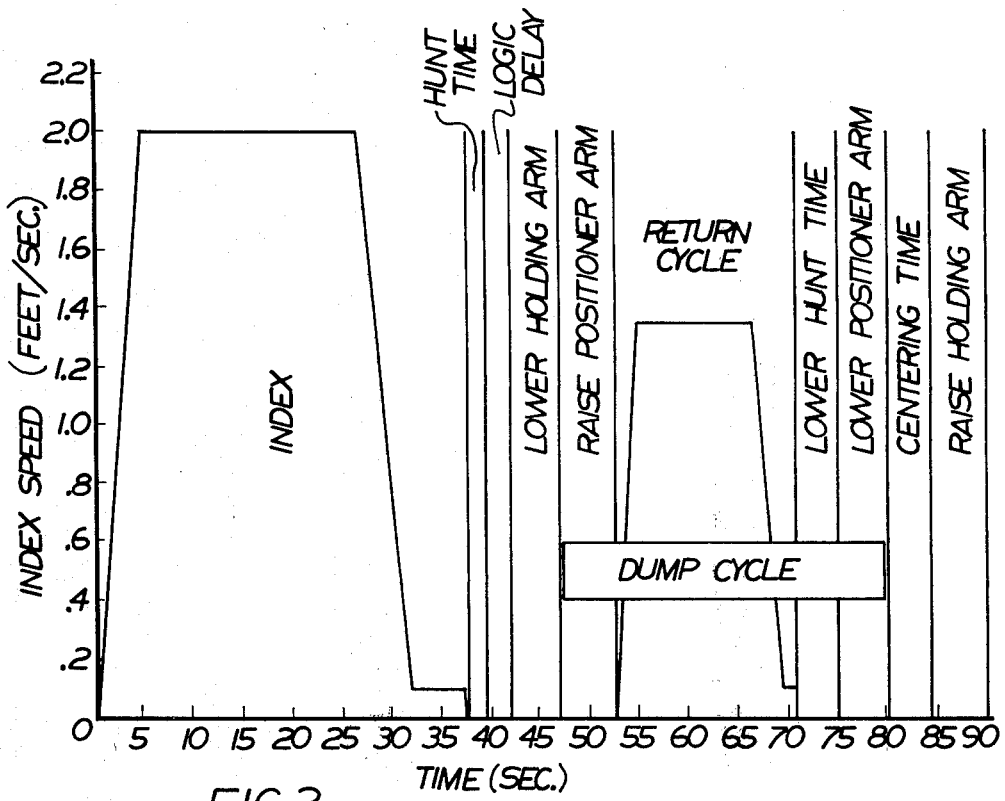
FIG. 2 is a graph illustrating the speeds of certain operations as a function of time employing a prior art indexing and dumping arrangement.

Referring now to FIG. 1, there is illustrated a plurality of railroad cars 10 representing a portion of a coupled unit train of gondola-type cars disposed on railroad tracks 11. The tracks 11 lead from right to left into a conventional, rotary railroad car dumper 12 schematically and partially shown in FIG. 1. The dumper 12 may be of the type set forth in U.S. Pat. No. 4,024,962, or may be any other conventional rotary car dumper. A currently popular type of car dumper particularly suited for emptying coupled cars in a unit train inverts the cars by revolving them about a longitudinal axis of the drawbars of the couplers joining the cars. In order to permit such inverting of the coupled cars of a unit train, the couplings are rotatable about that axis so that the car or cars 10 being emptied by the rotary dumper 12 may rotate relative to the other cars of the balance of the train. Such a unit train normally travels as a unit from a remote loading point to and through the unloading apparatus. A pair of shuttle cars 13 and 14 are mounted on tracks 15 and 16, which run parallel to the tracks 11. Each shuttle car 13 and 14 respectively carries a car-engaging pusher or member **16*a* and 16*b*. The members 16*a* and 16*b* are pivotally mounted on the shuttle cars by pivot rods 17, and are actuated from a substantially vertical position which clears the cars 10 to a substantially horizontal position to engage coupling members 18 between the cars. The coupling members 18 may be AAR-type "F" interlocking couplers. The coacting components of such couplers may be mounted on the railroad cars for rotation about their longitudinal draft gear axis so that the cars in the train may be rotated one or two at a time about the draft gear axis without being uncoupled from the other cars of the train. The couplers and arms may be of the type set forth in U.S. Pat. No. 3,942,451, the disclosure of which is incorporated herein by reference. The arms 16a and 16b are pivoted between a substantially horizontally position and a substantially vertical position by crank arms 19 and 20, which are connected to cranks 21 and 22. The cranks 21 and 22 are driven by motors 23 and 24**.

The driving mechanism further includes an arrangement for shifting the shuttle cars forwardly and rearwardly on a one-for-one correspondence as to position and rate of travel. This arrangement includes first and second pulleys 25 and 26, respectively, on the forward and rearward ends of each of the shuttle cars. A first cable 27 extends from a fixed member 28 around an idling pulley 29, around a driving winch 30 which is driven by a motor 31, around another idling pulley 32, and around the second pulley 26 on the shuttle car 14 to a fixed member 33. The second cable 34 extends from a fixed member 35 around the first pulley 25 on the shuttle car 13, around a pair of idling pulleys 36 and 37, and around the first pulley 25 on the shuttle car 14 to a fixed member 38. Obviously, the pulleys 29, 32, 36, and 37 are located below the level of the track 11 for clearance purposes. Furthermore, the cables 27 and 34 may be wrapped around the pulleys a number of times for better traction.

Figure 3:
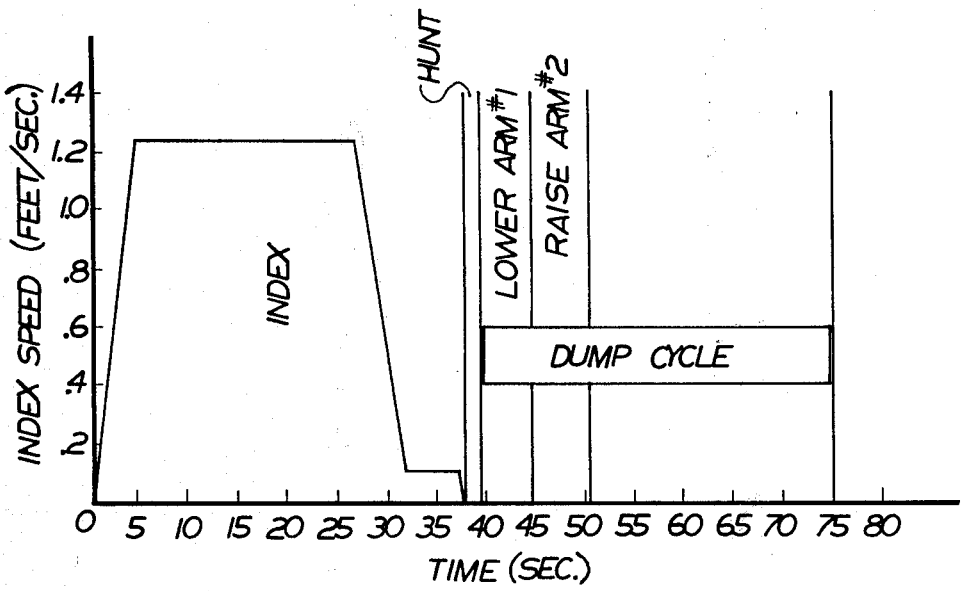
FIG. 3 is an illustration similar to FIG. 2 but illustrating the functions provided by the present invention.

In operation, and with reference to FIGS. 1 and 3, the shuttle car 14 is advanced and the shuttle car 13 is retracted by driving the pulley 30 in a clockwise direction. It may be seen that the shuttle car 14 is advanced by applied tension to the cable 34 by the shuttle car 13, as the shuttle car 13 is being drawn toward the fixed object 28. When a single car is indexed into position in the dumper 12, the arm 16b is lowered and subsequently the arm 16a is raised. Dumping takes place during these operations, since at least one of the arms is engaged with a coupling member 18. As may be seen in FIG. 3, the entire cycle takes 75 seconds.

In a prior art technique, such as the technique set forth in U.S. Pat. No. 4,006,691, the string of cars is driven forwardly, one car at a time, by a single arm. Indexing time is about the same as in the technique of the present invention. However, after indexing a holding arm must be lowered, and then the positioning or train advancing arm must be raised. The holding arm must be lowered before the dump cycle, which adds to total cycle time. After the positioner arm is raised, the arm returns to its pre-index position. After the dump cycle, the holding arm must be raised prior to advancement of the railroad car.

It should be appreciated that with a suitable vertical spacing for clearance, with one pulley 29 or 32 positioned over the other, with one of the pulleys 36 or 37 eliminated, and with one set of tracks 15 or 16 located over the other, both shuttle cars may operate on the same side of the railroad cars.

Although the preferred embodiment of this invention has been shown and described, it should be understood that various modifications and rearrangements of the parts may be resorted to without departing from the scope of the invention as disclosed and claimed herein.

What is claimed is:

1. In a train positioner for sequentially advancing a string of coupled railroad cars to a rotary car dumper in a step-by-step and a car-by-car sequence, each of said cars having rotatable couplings permitting the rotation of each car about a longitudinal axis, said rotary car dumper being adapted to invert a railroad car about said axis, said axis being colinear with the axis of the car coupling members of said car, in combination therewith the improvement which comprises at least two car pushing members adapted to sequentially engage a car's coupling, advance said car towards said dumper, and hold said car in the advanced position from movement in either direction, and, driving means to drive at least one of said pushing members forwardly toward said dumper a distance corresponding to about the length of a car while said at least one member is engaged with a car while simultaneously retracting at least another one of said members rearwardly away from said dumper a distance corresponding to about the length of the car while said at least another member is disengaged from said car.

2. The improvement according to claim 1, wherein said driving means advances and retracts all of said members on a one-for-one correspondence as to position and rate of travel.

3. The improvement according to claim 1, wherein said car pusher members comprise track-mounted shuttle cars on both sides of said string of coupled cars, said track-mounted shuttle cars having arms which are adapted to alternately engage a car to push the car forwardly and to clear the cars to permit the shuttle car to return to a retracted position.

4. The improvement according to claim 3, wherein said arms are pivotally connected to said shuttle cars and are adapted to pivot toward and away from said cars.

5. The improvement according to claim 4, wherein said arms are adapted to engage the car coupling members to advance said cars toward said car dumper.

6. In a train positioner for sequentially advancing a string of coupled railroad cars to a rotary car dumper in a step-by-step and car-by-car sequence, each of said cars having rotatable couplings permitting the rotation of each car about a longitudinal axis, said rotary car dumper being adapted to invert a railroad car about said axis, said axis being colinear with the axis of the car coupling member of said car, in combination therewith, the improvement which comprises two car pushing members adapted to sequentially engage a car and advance said car towards said dumper, said car pushing members comprising shuttle cars mounted on tracks on both sides of said string of cars and being adapted to travel on said tracks toward and away from said car dumper, car-engaging means mounted on each shuttle car adapted to engage a railroad car, driving means to drive one of said car pushing members forwardly towards said dumper a distance corresponding to about the length of a car while said car-engaging means on said one of said car pushing members is engaged with a car while simultaneously retracting the other one of said car pushing members rearwardly away from said dumper a distance corresponding to about the length of a car while said car-engaging means on said other one of said car-engaging means is disengaged from said car, said driving means comprising first and second pulleys on the forward and rearward ends respectively of each of said car pushing members, a first cable extending from a fixed member, around the second pulley on said one of said members, around a driving winch, around the second pulley on said another one of said members, and then to a fixed member, said driving means further comprising a second cable extending from a fixed member around the first pulley on said one of said members, around idler pulley means, around the first pulley on said other one of said members, and then to a fixed member.

7. The improvement according to claim 6, wherein said driving means advances and retracts said members on a one-for-one correspondence as to position and rate of speed.

8. The improvement according to claim 6, wherein said car-engaging means comprise arms adapted to alternately engage a car to push the car forwardly and to clear the cars to permit the shuttle car to return to a retracted position.

9. The improvement according to claim 8, wherein said arms are pivotally connected to said shuttle cars and are adapted to pivot toward and away from said cars.

10. The improvement according to claim 9, wherein said arms are adapted to engage the car coupling members to advance said cars toward said car dumper.

* * * * *